US006546211B1

(12) United States Patent
Shishikura

(10) Patent No.: US 6,546,211 B1
(45) Date of Patent: Apr. 8, 2003

(54) IMAGE PROCESSING APPARATUS AND IMAGE PROCESSING METHOD AND TONER SUPPLYING METHOD

(75) Inventor: Kenichiro Shishikura, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/998,202

(22) Filed: Dec. 3, 2001

(51) Int. Cl.[7] ..... G03G 15/00; B41J 2/175
(52) U.S. Cl. ..... 399/12; 347/86; 399/25
(58) Field of Search ..... 399/9, 12, 13, 399/24, 25, 27, 33, 107, 111, 258, 262; 222/DIG. 1, 167, 325; 347/19, 49, 86

(56) References Cited

U.S. PATENT DOCUMENTS 4,961,088 A * 10/1990 Gilliland et al. ..... 399/25
5,319,426 A * 6/1994 Baruch et al. ..... 399/33 X
6,019,461 A * 2/2000 Yoshimura et al. ..... 399/12 X
6,032,010 A * 2/2000 Kim et al. ..... 399/12 X
6,151,459 A * 11/2000 Hashimoto et al. ..... 399/12 X
6,256,469 B1 7/2001 Taniyama et al. ..... 399/258

FOREIGN PATENT DOCUMENTS

JP 10-161411 6/1998

* cited by examiner

*Primary Examiner*—Hoan Tran
(74) *Attorney, Agent, or Firm*—Foley & Lardner

(57) ABSTRACT

A temperature-sensitive sticker is disposed on a toner cartridge, a heater and a sensor is provided for a digital copying machine main body, and a change in color of the temperature-sensitive sticker and the color thereof are detected to detect the condition of the toner cartridge on the main body side.

15 Claims, 7 Drawing Sheets

IMAGE PROCESSING APPARATUS AND IMAGE PROCESSING METHOD AND TONER SUPPLYING METHOD

BACKGROUND OF THE INVENTION

The present invention relates to an image processing apparatus, such as an electronic copying machine. More particularly, it relates to an image processing apparatus, an image processing method, and a toner supplying method, whereby toner is supplied through a toner cartridge to process an image.

Hitherto, discrimination regarding a destination such as a country, an area, or the like regarding a toner cartridge is made by changing the shape of the toner cartridge and that of an apparatus main body. This discrimination is necessary to allow a standard electronic copying machine to process a fine image in accordance with the temperature and humidity of the country or area.

The group of inventors of the present invention has disposed cases of a toner cartridge utilizing the detection of the color of a sticker.

However, the condition of the toner in a toner cartridge in an electronic copying machine cannot be known at any particular time, and whether the toner cartridge is new or old also cannot be known in the conventional art.

BRIEF SUMMARY OF THE INVENTION

It is an object of the present invention to provide an image processing apparatus, an image processing method, and a toner supplying method, whereby whether a toner cartridge is new or old and the destination and the condition of toner can be detected without changing the shape of the toner cartridge and that of the apparatus main body.

To accomplish the above object, according to the present invention, there is provided an image processing apparatus for supplying toner to process an image, comprising: a toner cartridge, on which a temperature-sensitive sticker that irreversibly changes color at a predetermined temperature is disposed, the toner cartridge being set in the image processing apparatus to supply toner; a detecting section which detects the color of the temperature-sensitive sticker disposed on the toner cartridge when the toner cartridge is set in the image processing apparatus; a first control section which determines that the toner cartridge is new to control a toner supplying operation in the image processing apparatus when the color is detected as indicating a sticker that has not been temperature-sensed; and a second control section which determines that the toner cartridge has already been used to stop the toner supplying operation in the image processing apparatus when the color is detected as indicating a sticker that has been temperature-sensed.

According to the present invention, there is provided a toner supplying method of an image processing apparatus for supplying toner to process an image, comprising the steps of: detecting the color of a temperature-sensitive sticker disposed on a toner cartridge when the toner cartridge having thereon the temperature-sensitive sticker, which irreversibly changes color at a predetermined temperature, is set in the image processing apparatus; determining that the toner cartridge is new when the color of the temperature-sensitive sticker is detected as indicating a sticker that has not been temperature-sensed; and determining that the toner cartridge has already been used when the color of the temperature-sensitive sticker is detected as indicating a sticker that has been temperature-sensed.

According to the present invention, there is provided an image processing method for supplying toner to process an image, comprising the steps of: detecting the color of a temperature-sensitive sticker disposed on a toner cartridge when the toner cartridge having thereon the temperature-sensitive sticker, which irreversibly changes color at a predetermined temperature, is set in the image processing apparatus; heating the temperature-sensitive sticker at the predetermined temperature through a heater, to change the color when the color of the temperature-sensitive sticker is detected as indicating a sticker that has not been temperature-sensed; and controlling a fixing temperature in the image processing apparatus in accordance with the changed color.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the present invention will now be described hereinbelow with reference to the drawings.

Figure 1:
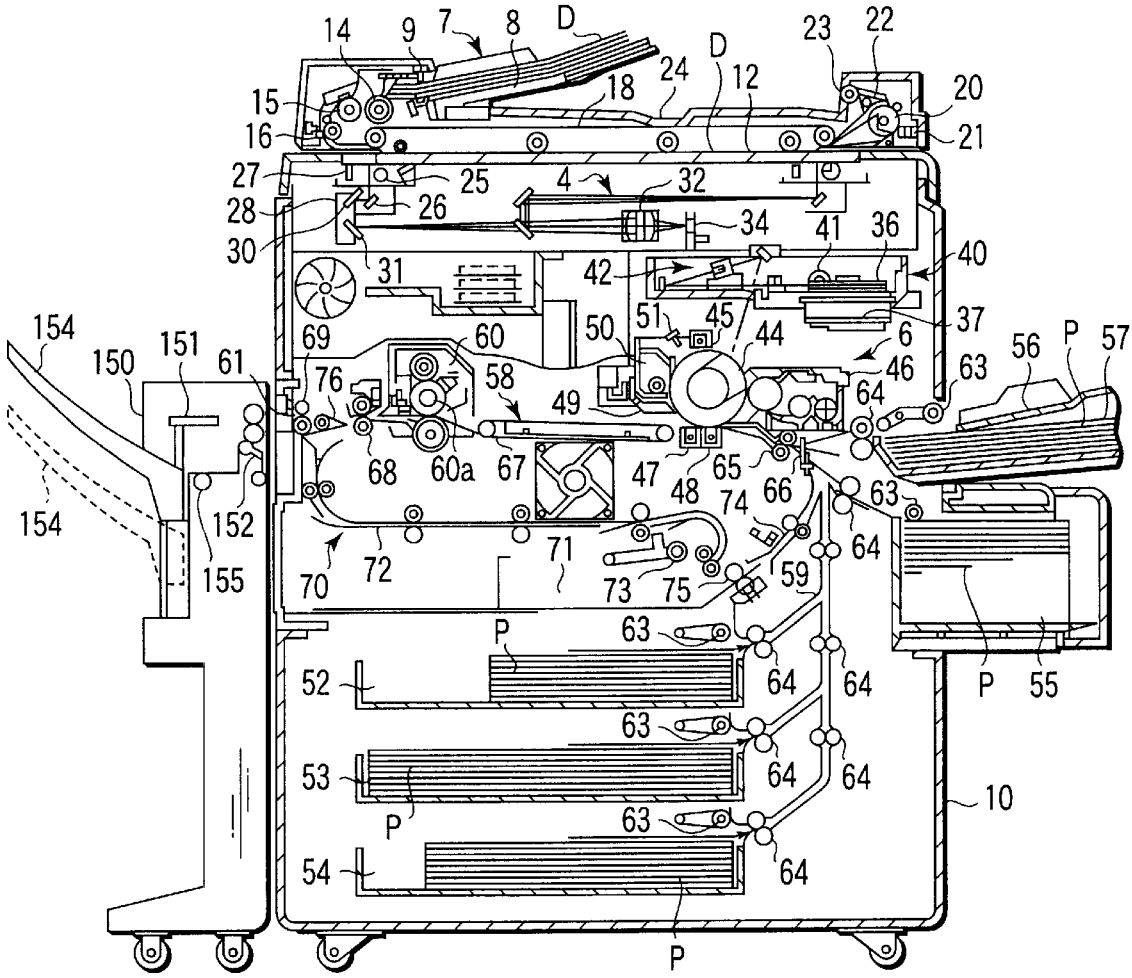
FIG. 1 is a sectional view schematically showing the internal configuration of a digital copying machine according to an image processing apparatus of the present invention.

FIG. 1 is a sectional view showing the internal structure of a digital copying machine (DPPC) according to an image processing apparatus of the present invention.

As shown in FIG. 1, the digital copying machine has an apparatus main body 10. The apparatus main body 10 includes a scanner section 4 which functions as an image reading device and a printer section 6 which functions as image processing means.

On the top surface of the apparatus main body 10, a document setting table 12 made of transparent glass, on which an object to be read, namely, a document sheet D is set, is provided. On the top surface of the apparatus main body 10, an automatic document feeder 7 (hereinbelow, referred to as an ADF) for automatically feeding document sheets onto the document setting table 12 is disposed. The ADF 7 is arranged so that it can be opened or closed with respect to the document setting table 12 and also functions as a document retainer for bringing the document sheet D placed on the document setting table 12 into contact with the document setting table 12.

The ADF 7 has a document tray 8 in which the document sheet D is set, an empty sensor 9 for detecting the presence or absence of the document sheet, a pickup roller 14 for sequentially taking the document sheet from the document tray 8 one by one, a sheet feeding roller 15 for conveying the taken document sheet, a pair of aligning rollers 16 for aligning the ends of the document sheet, and a conveying belt 18 disposed so as to substantially cover the entire document setting table 12. Each of document sheets set upwardly in the document tray 8 is sequentially taken out in such a manner that the lowermost sheet, namely, the last page is first taken out and is then aligned by the pair of aligning rollers 16, and after that, the document sheet is conveyed to a predetermined position on the document setting table 12 by the conveying belt 18.

In the ADF 7, a reversing roller 20, a non-reversion sensor 21, a flapper 22, and a sheet ejecting roller 23 are disposed in an end portion opposite to the pair of aligning rollers 16 across the conveying belt 18. The document sheet D whose image information is read by the scanner section 4, which will be described below, is fed from the document setting table 12 by the conveying belt 18 to be ejected to a document ejecting unit 24 on the top surface of the ADF 7 through the reversing roller 20, the flapper 21, and the sheet ejecting roller 22. When the rear side of the document sheet D is read, the flapper 22 is switched, whereby the document sheet D conveyed by the conveying belt 19 is reversed by the reversing roller 20, and after that, the document sheet D is again conveyed to the predetermined position on the document setting table 12 by the conveying belt 18.

The scanner section 4 arranged in the apparatus main body 10 includes an exposure lamp 25 as a light source for irradiating the document sheet D placed on the document setting table 12, and a first mirror 26 for deflecting light reflected by the document sheet D in a predetermined direction. The exposure lamp 25 and the first mirror 26 are attached to a first carriage 27 arranged below the document setting table 12.

The first carriage 27 is disposed to be movable in parallel to the document setting table 12 and is reciprocated below the document setting table 12 by a scanning motor (not shown) through a toothed belt (not shown) or the like.

A second carriage 28, which is movable in parallel to the document setting table 12, is disposed below the document setting table 12. Second and third mirrors 30 and 31 for sequentially deflecting the reflected light from the document sheet D, the light being deflected by the first mirror 26, are attached to the second carriage 28 so that the second and third mirrors are disposed perpendicular to each other. The second carriage 28 is driven by the toothed belt or the like for driving the first carriage 27, to follow the first carriage 27, and is also moved in parallel to the first carriage 27 along the document setting table 12 at a speed, which is ½ that of the first carriage.

An image forming lens 32 for converging light reflected by the third mirror 31 on the second carriage 28 and a CCD (photoelectric converting device) 34 for receiving the reflected light converged by the image forming lens to photoelectrically convert the light are disposed below the document setting table 12. The image forming lens 32 is arranged movably on a plane including the optical axis of the light reflected by the third mirror 31, via a driving mechanism, so as to form an image with the reflected light at a desired magnification. The CCD 34 photoelectrically converts the incident reflected light to generate an electric signal corresponding to the read document sheet D.

On the other hand, the printer section 6 has a laser exposing unit 40 serving as latent image forming means. The laser exposing unit 40 includes a semiconductor laser 41 as a light source, a polygon mirror 36 as a scanning member for successively deflecting laser beams emitted from the semiconductor laser 41, a polygon motor 37 as a scanning motor for rotating the polygon mirror 36 at a predetermined speed, and an optical system 42 for deflecting the laser beams from the polygon mirror 36, and guiding them to a photosensitive drum 44, which will be described below. The laser exposing unit 40 with such a configuration is fixed to a supporting frame (not shown) in the apparatus main body 10.

The semiconductor laser 41 is controlled to be turned on or off in accordance with image information of the document sheet D read by the scanner section 4 or facsimile transmission/reception document. The laser beams thereof are aimed at the photosensitive drum 44 through the polygon mirror 36 and the optical system 42. The laser beams scan the surface of the photosensitive drum 44 to form an electrostatic latent image on the surface of the photosensitive drum 44.

The printer section 6 has the rotatable photosensitive drum 44 serving as an image holding member disposed in a central portion of the apparatus main body 10. The surface of the photosensitive drum 44 is exposed by the laser beams from the laser exposing unit 40, whereby a desired electrostatic latent image is formed. A static charger 45 for charging the surface of the drum at a predetermined charge level, a developing device 46 for supplying toner as a developer to the electrostatic latent image formed on the surface of the photosensitive drum 44 to develop the latent image at a desired image density, and a separating charger 47 for separating a member, onto which an image is transferred, supplied from a sheet cassette, which will be described below, namely, a copy paper sheet P from the photosensitive drum 44 are integrally provided around the photosensitive drum 44. A transfer charger 48 for transferring the toner image formed on the photosensitive drum 44 onto the paper sheet P, a separating nail 49 for separating the copy paper sheet P from the surface of the photosensitive drum 44, a cleaning unit 50 for cleaning the toner remaining on the surface of the photosensitive drum 44, and a static eliminator 51 for removing the electrostatic charge remaining on the surface of the photosensitive drum 44 are subsequently arranged.

An upper-stage cassette 52, a middle-stage cassette 52, and a lower-stage cassette 54, each of which can be drawn from the apparatus main body, are disposed in the lower portion of the apparatus main body 10 in a stacked manner. The cassettes hold copy paper sheets of different sizes, respectively. A large-capacity feeder 55 is arranged adjacent to the cassettes. The large-capacity feeder 55 receives about 300 copy paper sheets P of a frequently-used size, for example, A4-size copy paper sheets P. A sheet feeding cassette 57 which is also used as a manual feeding tray 56 is detachably mounted above the large-capacity feeder 55.

In the apparatus main body 10, a conveying path 58 extending from each of the cassettes and the large-capacity feeder 55 through a transferring section disposed between the photosensitive drum 44 and the transferring charger 48 is formed. A fixing device 60 having a fixing lamp 60*a* is disposed at the end of the conveying path 58. An ejection port 61 is formed on the side wall of the apparatus main body 10, the side wall facing the fixing device 60. A finisher 150 as a single tray is attached to the ejection port 61.

In the vicinity of each of the upper-state cassette 52, the middle-stage cassette 53, the lower-stage cassette 54, the sheet feeding cassette 57, and the large-capacity feeder 55, a pickup roller 63 for sequentially taking out the paper sheet P from each of the cassettes and the large-capacity feeder is disposed. Many pairs of sheet feeding rollers 64 for conveying the copy paper sheet P taken out by the pickup roller 63 through the conveying path 58 are disposed in the conveying path 58.

A pair of resist rollers 65 are disposed in the conveying path 58 on the upstream side of the photosensitive drum 44. The pair of resist rollers 65 correct the inclination of the taken copy paper sheet P, align the front end of a toner image on the photosensitive drum 44 and that of the copy paper sheet P, and feed the copy paper sheet P to the transferring section at the same speed as the surface of the photosensitive drum 44. A pre-alignment sensor 66 for detecting the arrival of the copy paper sheet P is disposed in front of the pair of resist rollers 65, namely, adjacent to the sheet feeding rollers 64.

The copy paper sheets P, taken one by one from any one of the cassettes and the large-capacity feeder 55 by the pickup roller 63, is conveyed to the pair of resist rollers 65 by the pair of sheet feeding rollers 64. After the front end of the copy paper sheet P is aligned by the pair of resist rollers 65, the copy paper sheet P is sent to the transferring section.

In the transferring section, a developed image formed on the photosensitive drum 44, namely, a toner image is transferred onto the paper sheet P by the transferring charger 48. The copy paper sheet P, on which the toner image is transferred, is separated from the surface of the photosensitive drum 44 by the operations of the separating charger 47 and the separating nail 49 and is then conveyed to the fixing device 60 through a conveying belt 67 constituting one portion of the conveying path 58. After the developer image is melted to be fixed to the copy paper sheet P by the fixing device 60, the copy paper sheet P is ejected through the ejecting port 61 to the finisher 150 by a pair of sheet feeding rollers 68 and a pair of sheet ejecting rollers 69.

An automatic double-sided unit 70, for reversing the copy paper sheet P passed through the fixing device 60 to resend the copy paper P to the pair of resist rollers 65, is disposed below the conveying path 58. The automatic double-sided unit 70 includes a temporary accumulating unit 71 for temporarily accumulating the copy paper sheet P, a reversing path 72, which is branched from the conveying path 58, for reversing the copy paper sheet P passed through the fixing device 60 to guide the paper sheet to the temporary accumulating unit 71, a pickup roller 73 for taking out the copy paper sheet P accumulated in the temporary accumulating section one by one, and sheet feeding rollers 75 for feeding the taken paper sheet through a conveying path 74 to the pair of resist rollers 65. In a branch portion between the conveying path 58 and the revering path 72, a distributing gate 76 for selectively distributing the copy paper sheet P to the ejecting port 61 or reversing path 72 is disposed.

In case of double-sided copying, the copy paper sheet P passed through the fixing device 60 is guided to the reversing path 72 by the distributing gate 76 and is then temporarily accumulated in the temporary accumulating unit 71 as the paper sheet is reversed. After that, the copy paper sheet P is sent through the conveying path 74 to the pair of resist rollers 65 by the pickup roller 73 and the pair of sheet feeding rollers 75. After the copy paper sheet P is aligned by the pair of resist rollers 65, it is again sent to the transferring section and a toner image is transferred onto the rear surface of the copy paper sheet P. Then, the copy paper sheet P is ejected to the finisher 150 through the conveying path 58, the fixing device 60, and the sheet ejecting rollers 69.

The finisher 150 staples ejected partially constitutional document sheets every unit and stores the sheets. Each time the copy paper sheet P to be stapled is ejected from the ejecting port 61, the copy paper sheet is guided on the stapling side through a guide bar 151 to be aligned. When all of the paper sheets constituting one document are ejected, a sheet retaining arm 152 retains the ejected copy paper sheets P every unit and a stapler unit (not shown) staples the sheets. After that, the guide bar 151 is moved down and the stapled copy paper sheets P are ejected every unit to a finisher ejecting tray 154 by a finisher ejecting roller 155. The amount of downward movement of the finisher ejecting tray 154 is determined to some extent by the number of ejected copy paper sheets P. The finisher ejecting tray 154 is stepwise moved down upon each new batch of paper sheets P being ejected. The guide bar 151 for aligning the ejected copy paper sheet P is disposed so that the bar does not come into contact with the stapled copy paper sheets P placed on the finisher ejecting tray 154.

The finisher ejecting tray 154 is connected to a shift mechanism (not shown) for shifting the documents one by one (for example, in four directions of front, back, right, and left) in a sort mode.

Figure 2:
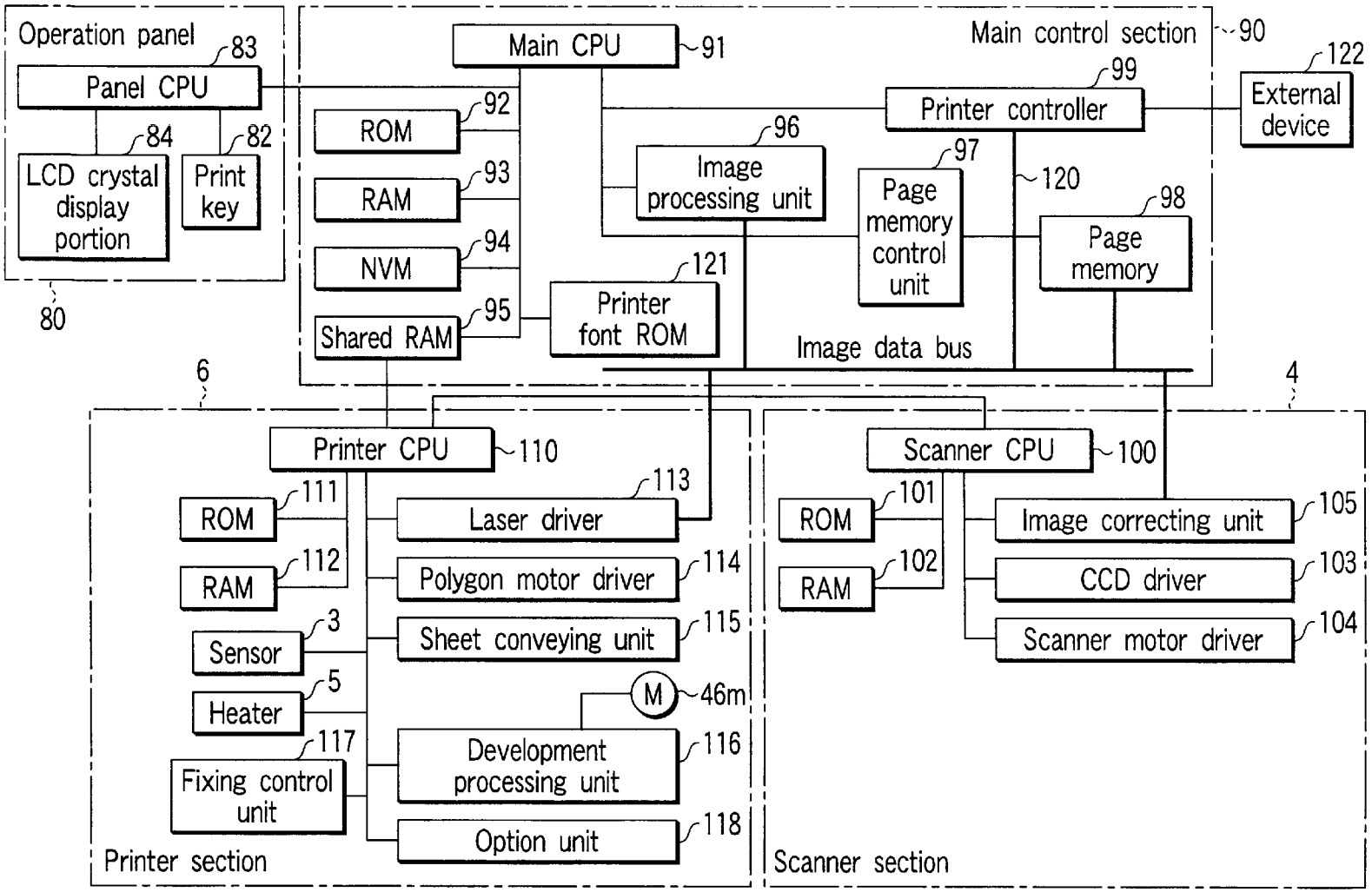
FIG. 2 is a block diagram schematically showing the flow of a signal for electrical connection and control in the digital copying machine in FIG. 1.

FIG. 2 shows a block diagram schematically showing the flow of a signal for electrical connection and control in the digital copying machine in FIG. 1. Referring to FIG. 2, the digital copying machine has three CPUs, namely, a main CPU 91 of a main control section 90, a scanner CPU 100 of the scanner section 4, and a printer CPU 110 of the printer section 6. The main CPU 91 bidirectionally communicates with the printer CPU 110 through a shared RAM 95. The main CPU 91 generates operation instructions. The printer CPU 110 returns a condition status. The printer CPU 110 serially communicates with the scanner CPU 100. The printer CPU 110 generates operation instructions. The scanner CPU 100 returns a condition status.

The operation panel 80 is connected to the main CPU 91.

The main control section 90 includes the main CPU 91, ROM 92, RAM 93, NVM 94, a shared RAM 95, an image processing unit 96, page memory control unit 97, page memory 98, printer controller 99, and printer font ROM 121.

The main CPU 91 controls the entire main control section 90. The ROM 92 stores a control program. The RAM 93 temporarily stores data.

The NVM (nonvolatile random access memory: nonvolatile RAM) 94 is a nonvolatile memory backed up by a battery (not shown). When the power source is turned off, data in the NVM 94 is held.

The shared RAM 95 is used for bidirectional communication between the main CPU 91 and the printer CPU 110.

The page memory controller 97 reads/writes image data from/to the page memory 98. The page memory 98 can store image data of a plurality of pages, and is so constituted that compressed image data, from the scanner section 4, can be stored for every page.

The page memory controller 97 is connected to a compression section 87 for compressing image data.

The printer font ROM 121 stores font data corresponding to print data.

The printer controller 99 develops print data from an external device 122 such as a personal computer to image data with the font data stored in the printer font ROM 121 at a resolution corresponding to data, which is added to the print data and which indicates a resolution.

The scanner section 4 includes the scanner CPU 100 for controlling the entire scanner section 4, a ROM 101 in which a control program is stored, a RAM 102 for storing data, a CCD driver 103 for driving the CCD sensor 34, a scan motor driver 104 for controlling the rotation of the motor for driving the exposure lamp 25 and the mirrors 26, 27, and 28, and an image correcting unit 105, which includes an A/D converting circuit for converting an analog signal from the CCD sensor 34 into a digital signal, a shading correction circuit for correcting the fluctuation of a threshold level for an output signal from the CCD sensor 34 caused by variations of the CCD sensor 34 or variations in ambient temperature, and a line memory for temporarily storing the digital signal, which is subjected to shading correction, from the shading correcting circuit.

The printer section 6 includes the printer CPU 110 for controlling the entire printer section 6, a ROM 111 in which a control program or the like is stored, an RAM 112 for storing data, a laser driver 113 for turning on/off light emission by the semiconductor laser 41, a polygon motor driver (motor control unit) 114 for controlling the rotation of the polygon motor 37 in the laser unit 40, a sheet conveying unit 115 for controlling the conveyance of the paper sheet P through the conveying path 58, a development processing unit 116 for performing the charging, developing and transferring operations through the static charger 45, the developing device 46, and the transferring charger 48, a fixing control unit 117 for controlling the fixing device 60, and an option unit 118.

As will be described in detail below, the printer CPU 110 is connected to a motor 46*m* through a sensor 3, a heater 5, and the development processing unit 116.

The image processing unit 96, the page memory 98, the printer controller 99, the image correcting unit 105, and the laser driver 113 are connected to an image data bus 120.

Figure 3:
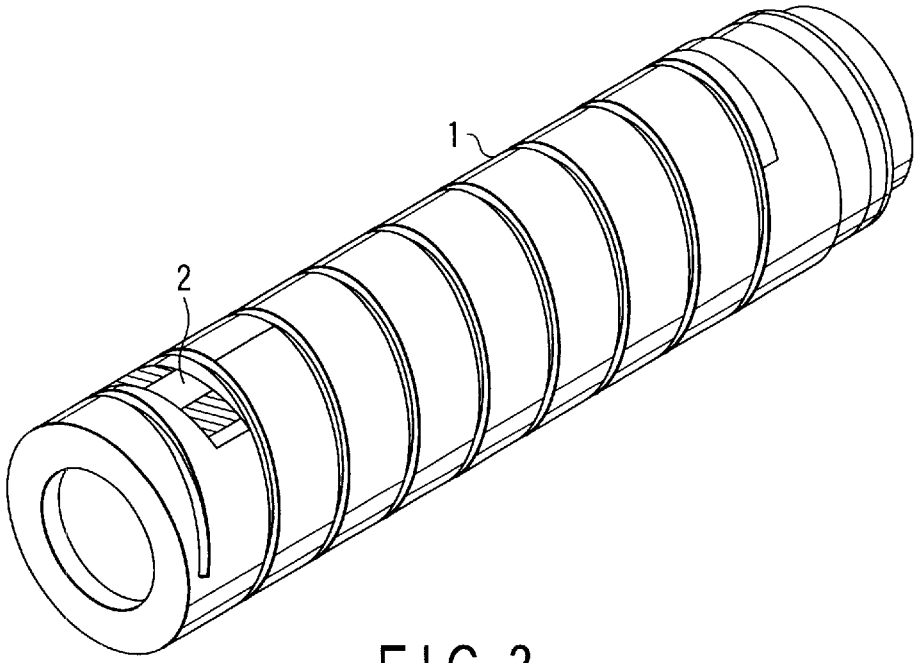
FIG. 3 is a view showing the external constructional example of a toner cartridge.

FIG. 3 shows an example of the external appearance of a toner cartridge 1 to be set in the developing device 46 according to the present invention. A temperature-sensitive sticker 2 is arranged at a predetermined position in the end portion of the toner cartridge 1.

The temperature-sensitive sticker 2 is a sticker which irreversibly turns from white to red when heat of a certain temperature is applied to the sticker.

Figure 4:
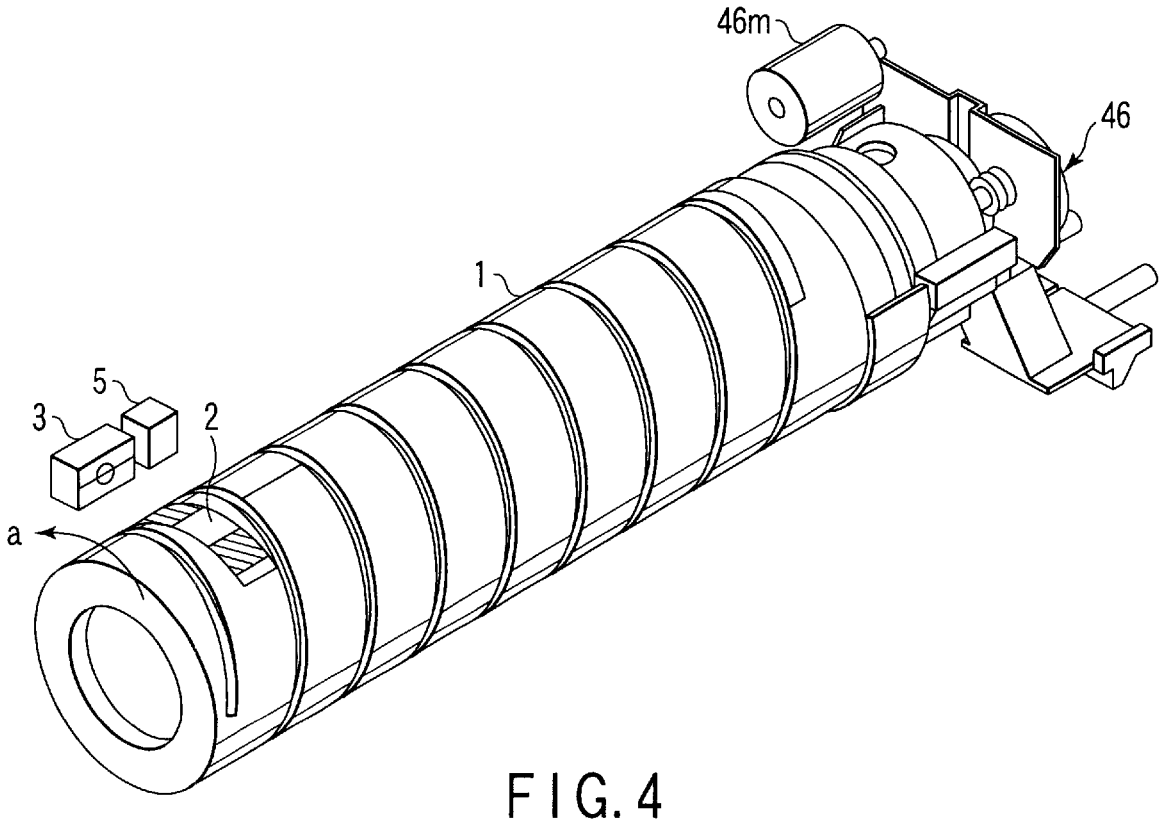
FIG. 4 is a view showing a state in which the toner cartridge is set in a cartridge set portion of a developing unit.

FIG. 4 shows a state in which the toner cartridge 1 is set in a cartridge set portion in the developing device 46 according to the present invention. The sensor 3 for detecting the color of the temperature-sensitive sticker 2 is disposed on the toner cartridge 1 when the toner cartridge 1 is inserted, and the heater 5 for changing the color of the temperature-sensitive sticker 2 are disposed in predetermined positions of the developing device 46. The developing device 46 operates the motor 46*m* to rotate the toner cartridge 1 in the direction shown by the arrow a to supply toner smoothly.

Figure 5:
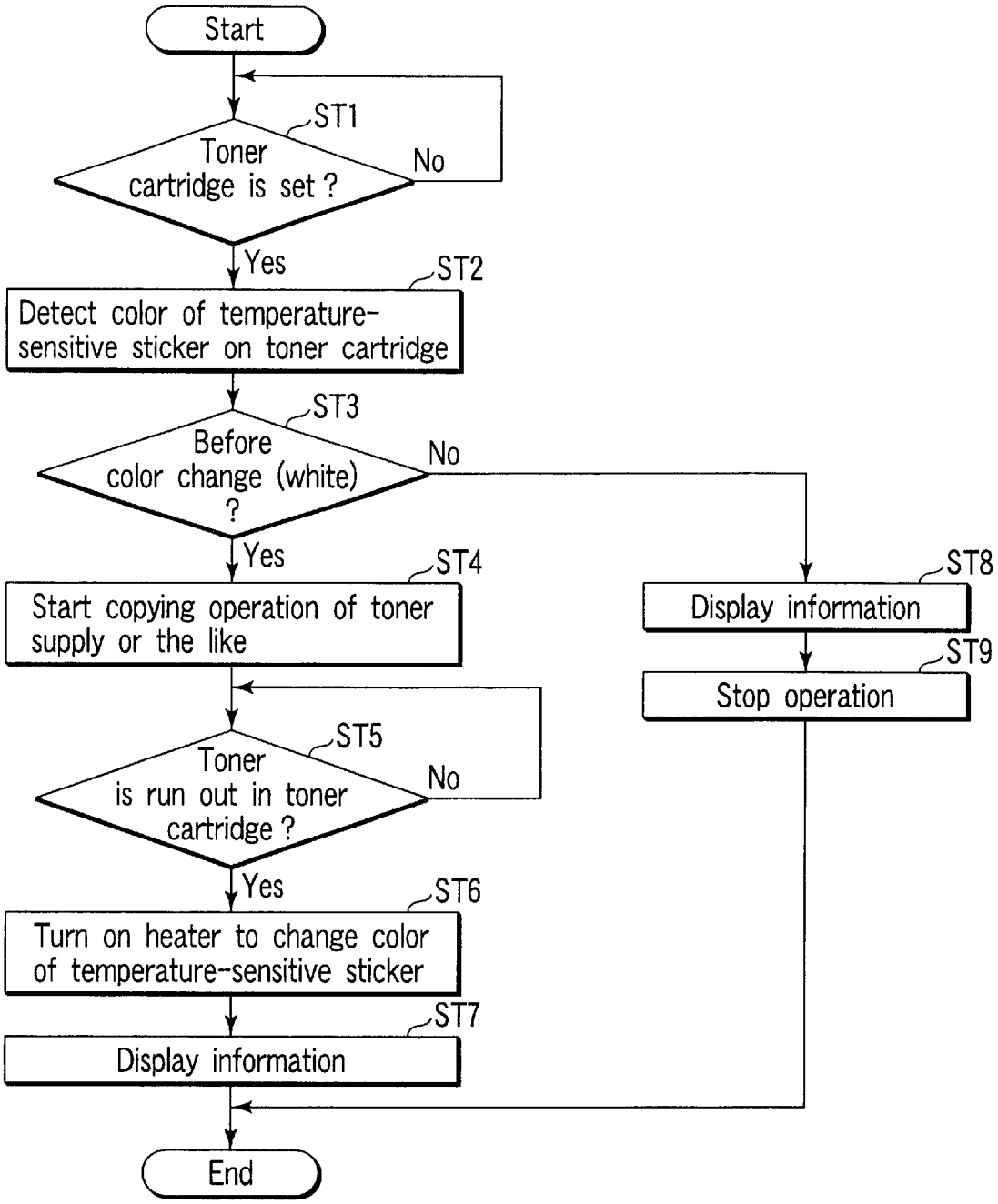
FIG. 5 is a flowchart for explaining the operation according to a first embodiment.

Subsequently, the operation according to the first embodiment in the above-mentioned constitution will now be described with reference to a flowchart in FIG. 5.

In the first embodiment, whether the toner cartridge is new or it has already been used is determined.

When the toner cartridge 1 is inserted into the developing device 46 (ST1), the main CPU 91 controls the motor 46*m* to rotate the developing device 46 to detect the color of the temperature-sensitive sticker 2 arranged on the toner cartridge 1 through the sensor 3 (ST2).

As to the color of the temperature-sensitive sticker 2 in the present embodiment, a color-change temperature of, for example, 40° C., the color before color change is white, and the color after color change is red.

When the detected color is white (before color change) (ST3), the main CPU 91 determines that the toner cartridge 1 is new and then starts the copying operation of toner supply or the like (ST4). Further, the main CPU 91 controls a liquid crystal display portion 84 in an operation panel 80 to display information indicating the normal operation, e.g., "Toner is being supplied" or the like.

When a sensor (not shown) detects that the toner in the toner cartridge 1 has run out (ST5), the main CPU 91 turns on the heater 5 to heat the temperature-sensitive sticker 2 to 40° C. or more, thereby changing the color to red (color change) (ST6). Further, the main CPU 91 allows the liquid crystal display portion 84 in the operation panel 80 to display information indicating replacement time of the toner cartridge 1 (ST7).

When the color detected in step ST3 is red (the color has already been changed), the main CPU 91 controls the liquid crystal display portion 84 in the operation panel 80 to display information "Used toner cartridge. Set new toner cartridge" (ST8) to catch the user's attention. The main CPU 91 stops the operation of toner supply or the like (ST9).

As mentioned above, according to the first embodiment, even when the user insets a used toner cartridge by mistake, the temperature-sensitive sticker is not white, but red, so that the operation of toner supply or the like can be stopped.

Since whether the toner cartridge is new or has already been used can be determined on the main body side, in accordance with the detection result, the operation panel can inform the user of the condition of the apparatus.

Figure 6:
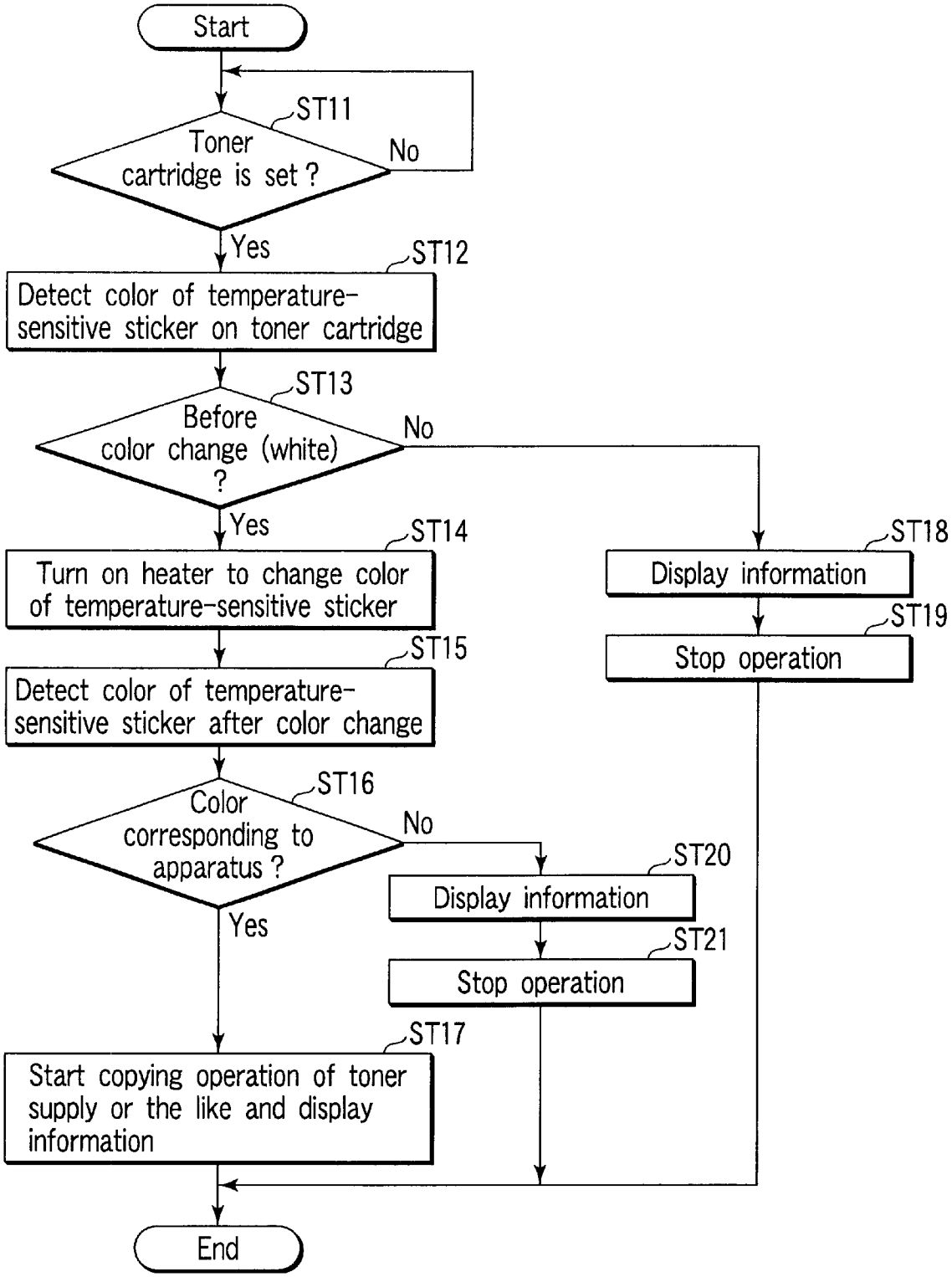
FIG. 6 is a flowchart for explaining the operation according to a second embodiment.

Subsequently, the operation according to a second embodiment will now be described with reference to the flowchart in FIG. 6.

According to the second embodiment, the destination of the toner cartridge is determined. In the present embodiment, the color of the temperature-sensitive sticker after temperature change is varied for each destination. For example, the sticker for domestic use is red, the sticker for foreign use is blue, and the sticker for use in other areas is yellow. In the present embodiment, the sensor 3 detects white, red, blue, and yellow.

When the toner cartridge 1 is inserted into to the developing device 46 (ST1), the main CPU 91 controls the motor 46*m* to rotate the developing device 46 to detect the color of the temperature-sensitive sticker 2 on the toner cartridge 1, through the sensor 3 (ST12).

When the detected color is white (before color change) (ST13), the main CPU 91 turns on the heater 5 to heat the temperature-sensitive sticker 2 to a predetermined temperature or higher, thereby changing the color (ST14).

The main CPU 91 detects the changed color of the temperature-sensitive sticker 2 through the sensor 3 (ST15) to determine whether the color corresponds to the present apparatus or not. (ST16).

When the determination result indicates the corresponding color, the main CPU 91 starts the copying operation of toner supply or the like and further indicates, via controls allows the liquid crystal display portion 84 of the operation panel 80 to display information indicating the normal operation, e.g., "Toner is being supplied" or the like (ST17).

When the color detected in step ST13 is the changed color, the main CPU 91 controls the liquid crystal display portion 84 of the operation panel 80 to display the information "Used toner cartridge. Insert new toner cartridge" (ST18) to catch the user's attention. The main CPU 91 stops the operation of toner supply or the like (ST19).

In step S16, for example, when the toner cartridge 1 for foreign use or use in other areas is used in an apparatus designed for domestic use, the sensor 3 cannot detect red, indicative of the domestic specification. The sensor 3 detects blue or yellow.

Consequently, the main CPU 91 via the liquid crystal display portion 84 of the operation panel 80, displays the information "Toner cartridge of different destination. Insert toner cartridge of correct destination" to catch the user's attention (ST20). The main CPU 91 stops the operation of toner supply or the like (ST21)

In case where the toner cartridge 1 for domestic use is used in an apparatus for foreign use, since the temperature-sensitive sticker 2 turns to red, the sensor 3 cannot detect blue, thus the apparatus main body is not operated. Similarly, in the apparatus for use in other areas, when the cartridge for a different destination is used, the apparatus main body is not operated.

In this case, as the sensor 3, a sensor for detecting four colors, namely, white, red, blue, and yellow is used.

When the number of destinations is increased, the number of colors of the temperature-sensitive sticker and the number of colors to be detected by the sensor 3 may be increased.

In the above-mentioned embodiment, the sensor has to discriminate between white and other colors for the respective destinations, resulting in an increase of the cost of the sensor. Accordingly, the sensor may detect two colors, for example, white and red, white and blue, or the like for each destination. In this case, after the heater is turned on, the sensor does not detect any color other than the previously designated colors. Accordingly, when the sensor does not detect any color, the next operation of the apparatus main body is not performed.

Furthermore, to decrease the cost of the sensor, the temperature-sensitive sticker can be set so that the reaction temperature and color are varied for every destination. For example, the sticker for domestic use may turn to red at 40° C., one for foreign use may turn to blue at 50° C., and one for use in other areas may turn to yellow at 60° C. As to the heater on the main body side, in accordance with the above setting, the heater for domestic use is set to 40° C., one for foreign use is set to 50° C., and one for use in other areas is set to 60° C.

In the above setting, in the case where the cartridge for foreign use or use in other areas is inserted into the apparatus for domestic use, white is initially detected, and the heater is turned on, the color of the temperature-sensitive sticker is not changed. That is, the sensor for domestic use can be replaced with a low-cost sensor for detecting white alone. In other words, in the case where white is detected, the heater is then turned on, the color of the temperature-sensitive sticker is not changed and white is again detected, the fact that the cartridge is not for domestic use can be determined.

As mentioned above, according to the second embodiment, whether the cartridge is a new or old toner cartridge, and the intended destination can be detected.

When the user does not use the correct toner cartridge, information that "Used toner cartridge. Insert new toner cartridge" or "Different destination. Insert proper toner cartridge" can be displayed on the screen of the operation panel, to catch the user's attention.

Accordingly, whether the cartridge is a new or used toner cartridge, and an error regarding the destination, can be detected on the main body side. In accordance with the detection result, the screen of the operation panel or the like can inform the user of the condition of the apparatus.

Figure 7:
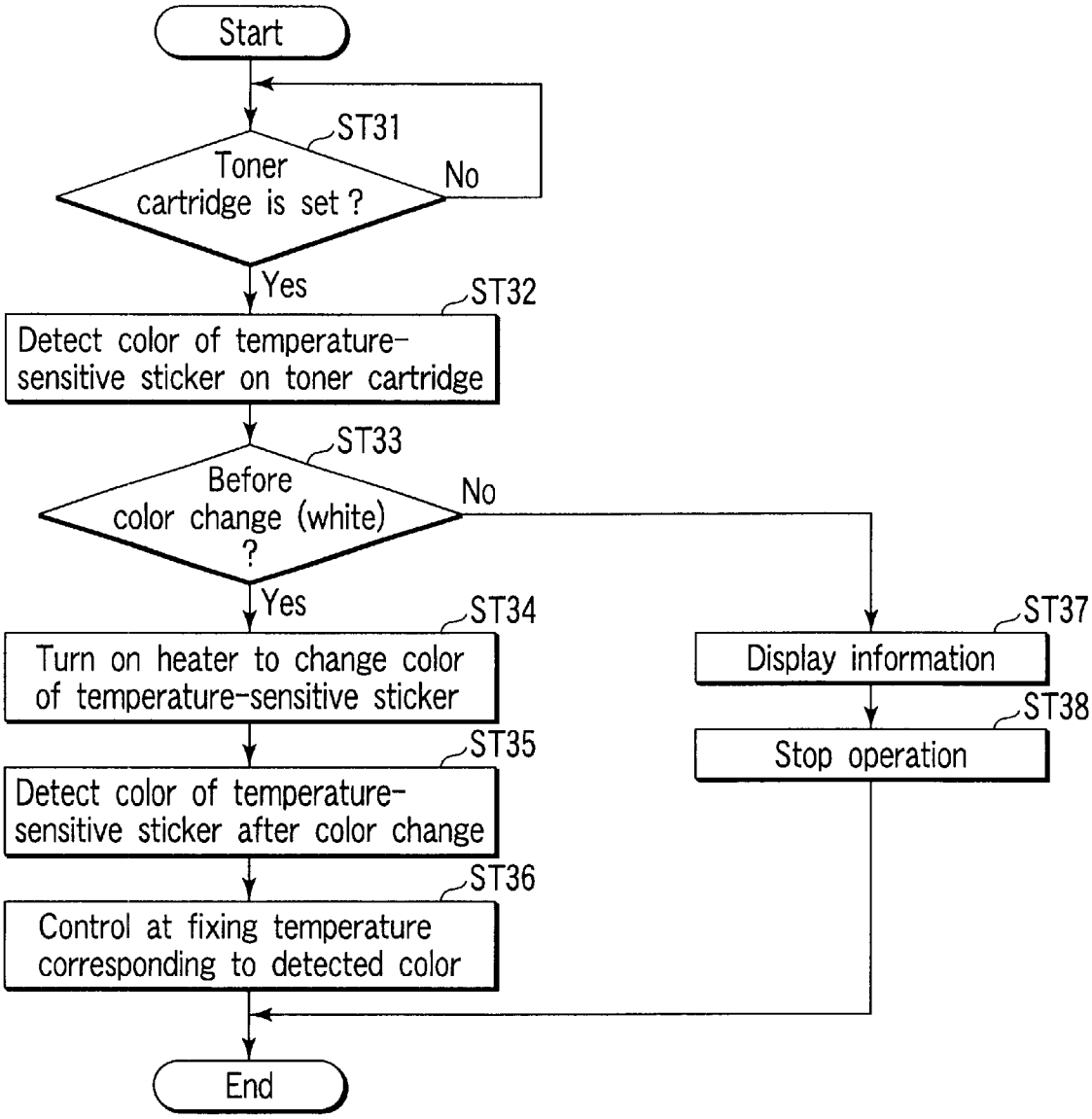
FIG. 7 is a flowchart for explaining the operation according to a third embodiment.

Subsequently, the operation of a third embodiment will now be described with reference to the flowchart in FIG. 7.

The third embodiment relates to a case of controlling the setting on the main body side, namely, control of the hardening temperature of the toner. In other words, toner is fixed onto the paper sheet by heat and pressure. In this case, the fixing temperature is controlled by using the reaction color of the temperature-sensitive sticker 2. Specifically, the reaction color of the temperature-sensitive sticker 2 is detected through the sensor 3 on the main body side, thereby changing the fixing temperature of the fixing device 60. For instance, when the reaction color of the temperature-sensitive sticker 2 is red, the fixing temperature is set to 160° C., in case of blue, the fixing temperature is set to 170° C., and in case of yellow, the fixing temperature is set to 180° C.

When the toner cartridge 1 is inserted into the developing device 46 (ST31), the main CPU 1 first controls the motor 46*m* to rotate the developing device 46 so that the sensor 3 can detect the color of the temperature-sensitive sticker 2 disposed on the toner cartridge 1 (ST32).

When the detected color is white (before color change) (ST33), the main CPU 91 turns on the heater 5 to heat the temperature-sensitive sticker 2 to a predetermined temperature or higher, thereby changing the color (ST34).

The main CPU 91 uses the sensor 3 to detect the changed color of the temperature-sensitive sticker 2 (ST35).

When the detected color is red, the main CPU 91 controls the fixing temperature applied by the fixing device 60 to be 160° C. When the detected color is blue, the main CPU 91 controls the fixing temperature applied by the fixing device 60 to be 170° C. When the detected color is yellow, the main CPU 91 controls the fixing temperature applied by the fixing device 60 to be 180° C. (ST36)

When the color detected in step ST33 is changed, the main CPU 91 controls the liquid crystal display portion 84 of the operation panel 80 to display information such as "Used toner cartridge. Insert new toner cartridge" (ST37) to catch the user's attention. The main CPU 91 stops the operation of toner supply or the like (ST38).

As mentioned above, according to the above-mentioned third embodiment, the toner cartridge can supply toner appropriate to every area throughout the world.

For example, in cold climates, since the ambient temperature is generally low, a low temperature can be assumed in transportation or the like. In other words, a toner having a low hardening temperature can be supplied. Since a temperature at which the toner starts to harden is proportional to the fixing temperature, a low hardening temperature means that the fixing temperature can also be set low. Accordingly, in cold climates, the expenditure of energy can be lowered. Moreover, the warm-up time of the fixing device can also be reduced.

When the toner cartridge having the temperature-sensitive sticker thereon is used, detection can be made on the main body side. In accordance with the detection result, the screen of the operation panel or the like can inform the user of the condition of the apparatus.

The present embodiment can be combined with the first and second embodiments depending on the number of discriminated colors the sensor can detect, and the combination of colors.

Subsequently, the operation according to a fourth embodiment will now be described with reference to the above-described flowchart in FIG. 7.

The fourth embodiment relates to a case of controlling the setting on the main body side, namely, control of the fixing property (fixing degree of toner: fixing rate).

In other words, as the fixing temperature is higher, the toner is fixed more stably (the fixing rate is high). Accordingly, in the present embodiment, the temperature-sensitive sticker on the toner cartridge indicating the fixing rate desired by the user is determined to control the fixing temperature.

For example, when the reaction color of the temperature-sensitive sticker 2 is red, the fixing temperature is set to 180° C. In the case of blue, the fixing temperature is set to 190° C. In the case of yellow, the fixing temperature is set to 200° C.

When the toner cartridge 1 is set in the developing device 46 (ST31), the main CPU 91 first controls the motor 46*m* to rotate the developing device 46 for the sensor 3 to detect the color of the temperature-sensitive sticker 2 disposed on the toner cartridge 1 (ST32).

When the detected color is white (before color change) (ST33), the main CPU 91 turns on the heater 5 to heat the temperature-sensitive sticker 2 to a predetermined temperature or higher, thereby changing the color (ST34).

The main CPU 91 detects the changed color of the temperature-sensitive sticker 2 through the sensor 3 (ST35).

When the detected color is red, the main CPU 91 controls the fixing temperature applied by the fixing device 60 to be 180° C. When the detected color is blue, the main CPU 91 controls the fixing temperature applied by the fixing device 60 to be 190° C. When the detected color is yellow, the main CPU 91 controls the fixing temperature applied by the fixing device 60 to be 200° C. (ST36).

When the color detected in step ST33 is a changed color, the main CPU 91 controls the liquid crystal display portion 84 of the operation panel 80 to display the information "Used toner cartridge. Insert new toner cartridge" (ST37) to catch the user's attention. Then, the main CPU 91 stops the operation of toner supply or the like (ST38).

As mentioned above, according to the above-mentioned fourth embodiment, the color is detected by the sensor, so that the fixing temperature can be controlled on the main body side.

The user buys a toner cartridge having thereon the temperature-sensitive sticker corresponding to a desired fixing rate, so that he or she can copy at the desired fixing rate without changing the settings on the main body side.

The setting of the fixing temperature can be detected on the main body side by using the toner cartridge, so that the screen of the operation panel or the like can inform the user of the condition of the apparatus in accordance with the detection result.

The present embodiment can be combined together with the first and second embodiment depending on the number of discriminated colors the sensor can detect, and the combinations of colors.

Figure 8:
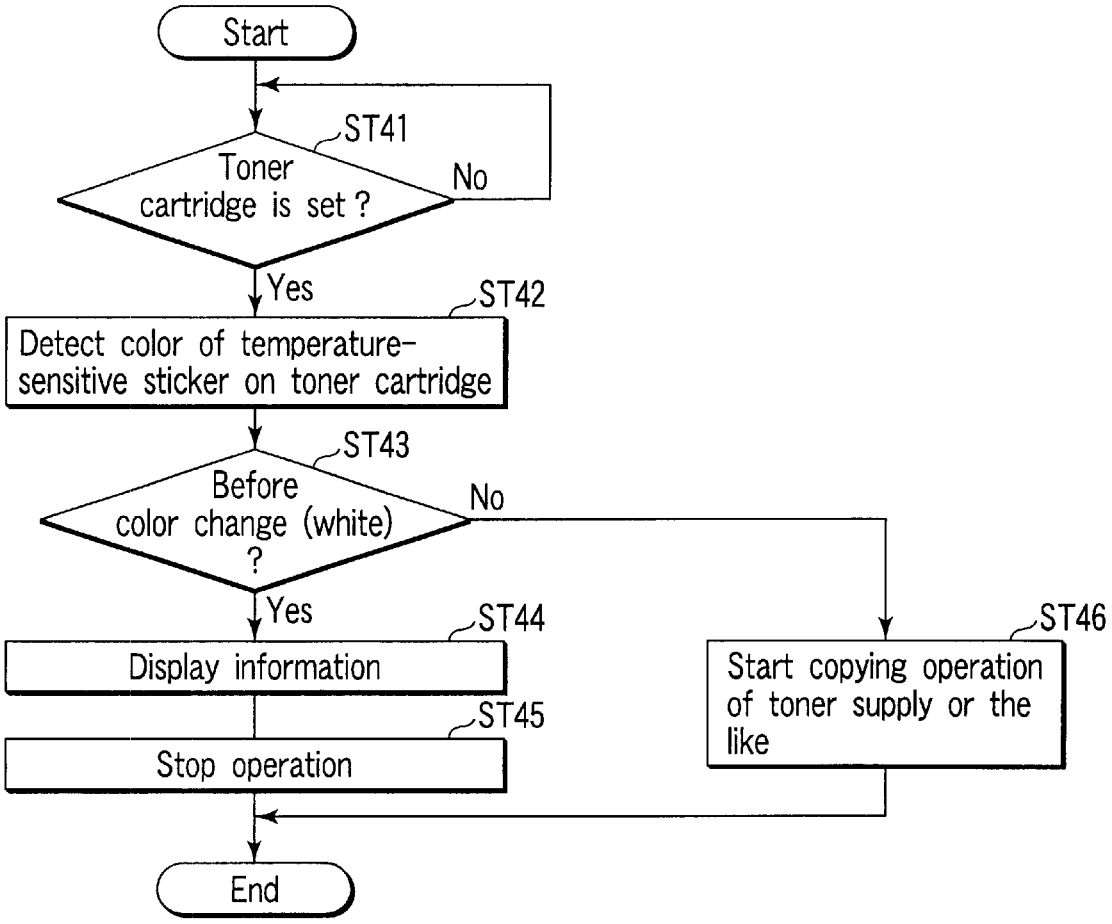
FIG. 8 is a flowchart for explaining the operation according to a fifth embodiment.

Next, the operation according to a fifth embodiment will now be described with reference to the flowchart in FIG. 8.

According to the fifth embodiment, the condition of toner in the toner cartridge is detected.

After shipment of the digital copying machine shown in FIG. 1 from a factory, the toner cartridges 1 filled with toner are transported all over the world.

On the other hand, the toner starts to harden when the ambient temperature rises to 50° C. Accordingly, when the ambient temperature exceeds 50° C. in transportation to a tropical region, the toner may harden in some cases. Thus, if the user is not aware of this fact, then uses the toner cartridge, a normal image cannot be produced, in some cases.

According to the present embodiment, the temperature-sensitive sticker 2 which reacts at 50° C. to turn to red is disposed on the toner cartridge 1.

In the present embodiment, the heater 5 is not used.

When the toner cartridge 1 is inserted into the developing device 46 (ST41), the main CPU 91 controls the motor 46*m* to rotate the developing device 46, to detect the temperature-sensitive sticker 2 disposed on the toner cartridge 1 through the sensor 3 (ST42).

When the detected color is red (changed color) (ST43), the main CPU 91 controls the liquid crystal display portion 84 of the operation panel 80 to display the information "Defective toner cartridge. Replace with good toner cartridge" (ST44) to catch the user's attention. Then, the main CPU 91 stops the operation of toner supply or the like (ST45).

When the color detected in step ST43 is white (color is not changed), the main CPU 91 starts the copying operation of toner supply or the like from the set toner cartridge (ST46).

As mentioned above, according to the above-mentioned fifth embodiment, a defective toner cartridge can be detected.

A defective toner cartridge can be detected on the main body side, so that the screen in the operation panel can inform the user of the detection result.

If the temperature-sensitive sticker on the toner cartridge is visually checked, defective toner cartridges can be detected before distribution to the user.

The present embodiment can be embodied together with the first and second embodiments depending on the number of discriminated colors the sensor detects, and the combinations of colors, provided that the temperature of the heater on the main body side is set to 50° C. or higher.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image processing apparatus for supplying toner to process an image, comprising:

a toner cartridge, on which a temperature-sensitive sticker that irreversibly changes color at a predetermined temperature is disposed, the toner cartridge being set in the image processing apparatus to supply toner;

a detecting section which detects the color of the temperature-sensitive sticker disposed on the toner cartridge when the toner cartridge is set in the image processing apparatus;

a first control section which determines that the toner cartridge is new to control a toner supplying operation in the image processing apparatus when the color is detected as indicating a sticker that has not been temperature-sensed; and a second control section which determines that the toner cartridge has already been used to stop the toner supplying operation in the image processing apparatus when the color is detected as indicating a sticker that has been temperature-sensed.

2. The apparatus according to claim 1, wherein the first control section controls to display information indicating that the toner cartridge is new in a display portion provided in the image processing apparatus.

3. The apparatus according to claim 1, wherein the second control section controls, to display information indicating that the toner cartridge has already been used, in a display portion provided for the image processing apparatus.

4. The apparatus according to claim 1, wherein, when the toner has run out in the toner cartridge, the first control section controls to heat the temperature-sensitive sticker disposed on the toner cartridge at the predetermined temperature through a heater to change the color.

5. An image processing apparatus for supplying toner to process an image, comprising:

a toner cartridge, on which a temperature-sensitive sticker that irreversibly changes color at a predetermined temperature is disposed, the toner cartridge being set in the image processing apparatus to supply toner;

a first detecting section which detects the color of the temperature-sensitive sticker disposed on the toner cartridge when the toner cartridge is set in the image processing apparatus;

a first control section which controls to heat the temperature-sensitive sticker at the predetermined temperature through a heater, which is previously arranged, to change the color when the color is detected as indicating a sticker that has not been temperature-sensed;

a second detecting section which detects the color of the temperature-sensitive sticker which is changed by the control through the first control section;

a determining section which determines whether the color detected by the second detecting section is a color corresponding to the image processing apparatus;

a second control section which controls a toner supplying operation in the image processing apparatus when the determining section determines that the color corresponds to the image processing apparatus; and a third control section which controls to stop the toner supplying operation in the image processing apparatus because the toner cartridge is not compatible with the image processing apparatus when the determining section determines that the color does not correspond to the image processing apparatus.

6. The apparatus according to claim 5, wherein the determining section determines whether a destination of the image processing apparatus matches a destination of the toner cartridge set in the image processing apparatus.

7. The apparatus according to claim 5, wherein the second control section controls to display information indicating that the apparatus is in a normal operation state, including toner supply, in a display portion provided for the image processing apparatus.

8. The apparatus according to claim 5, wherein the third control section controls to display information indicating that the toner cartridge is not compatible with the image processing apparatus in a display portion provided for the image processing apparatus.

9. An image processing apparatus for supplying toner to process an image, comprising:

a toner cartridge, on which a temperature-sensitive sticker that irreversibly changes color at a predetermined temperature is disposed, the toner cartridge being set in the image processing apparatus to supply toner;

a first detecting section which detects the color of the temperature-sensitive sticker disposed on the toner cartridge when the toner cartridge is set in the image processing apparatus;

a first control section which controls to heat the temperature-sensitive sticker at the predetermined temperature through a heater, which is previously arranged, to change the color when the color is detected as indicating a sticker that has not been temperature-sensed;

a second detecting section which detects the color of the temperature-sensitive sticker by the control through the first control section; and a second control section which controls a fixing temperature in the image processing apparatus in accordance with the color detected by the second detecting section.

10. An image processing apparatus for supplying toner to process an image, comprising;

a toner cartridge, on which a temperature-sensitive sticker that irreversibly changes color at a predetermined temperature is disposed, the toner cartridge being set in the image processing apparatus to supply toner;

a detecting section which detects the color of the temperature-sensitive sticker disposed on the toner cartridge when the toner cartridge is set in the image processing apparatus;

a first control section which controls to stop a toner supplying operation in the image processing apparatus on the basis of determination that the toner cartridge is defective when the color is detected as indicating a sticker that has been temperature-sensed; and a second control section which controls the toner supplying operation in the image processing apparatus on the basis of determination that the toner cartridge is good when the color is detected as indicating a sticker that has not been temperature-sensed.

11. The apparatus according to claim 10, wherein the color of the temperature-sensitive sticker disposed on the toner cartridge is changed at a temperature at which the toner in the toner cartridge starts to harden.

12. A toner supplying method of an image processing apparatus for supplying toner to process an image, comprising the steps of:

detecting the color of a temperature-sensitive sticker disposed on a toner cartridge when the toner cartridge having thereon the temperature-sensitive sticker, which irreversibly changes color at a predetermined temperature, is set in the image processing apparatus;

determining that the toner cartridge is new when the color of the temperature-sensitive sticker is detected as indicating a sticker that has not been temperature-sensed; and determining that the toner cartridge has already been used when the color of the temperature-sensitive sticker is detected as indicating a sticker that has been temperature-sensed.

13. A toner supplying method of an image processing apparatus for supplying toner to process an image, comprising the steps of:

detecting the color of a temperature-sensitive sticker disposed on a toner cartridge when the toner cartridge having thereon the temperature-sensitive sticker, which irreversibly changes color at a predetermined temperature, is set in the image processing apparatus;

heating the temperature-sensitive sticker at the predetermined temperature through a heater, to change the color when the color of the temperature-sensitive sticker is detected as indicating a sticker that has not been temperature-sensed;

determining whether the changed color is a color corresponding to the image processing apparatus;

starting a toner supplying operation when it is determined that the color corresponds to the image processing apparatus; and stopping the toner supplying operation when it is determined that the color does not correspond to the image processing apparatus.

14. An image processing method for supplying toner to process an image, comprising the steps of:

detecting the color of a temperature-sensitive sticker disposed on a toner cartridge when the toner cartridge having thereon the temperature-sensitive sticker, which irreversibly changes color at a predetermined temperature, is set in the image processing apparatus;

heating the temperature-sensitive sticker at the predetermined temperature through a heater, to change the color when the color of the temperature-sensitive sticker is detected as indicating a sticker that has not been temperature-sensed; and controlling a fixing temperature in the image processing apparatus in accordance with the changed color.

15. A toner supplying method of an image processing apparatus for supplying toner to process an image, comprising the steps of:

detecting the color of a temperature-sensitive sticker disposed on a toner cartridge when the toner cartridge having thereon the temperature-sensitive sticker, which irreversibly changes color at a predetermined temperature, is set in the image processing apparatus;

determining that the toner cartridge is defective when the color is detected as indicating a sticker that has been temperature-sensed; and determining that the toner cartridge is good when the color is detected as indicating a sticker that has not been temperature-sensed.

* * * * *